US006241177B1

(12) United States Patent
Schroter et al.

(10) Patent No.: US 6,241,177 B1
(45) Date of Patent: Jun. 5, 2001

(54) METHOD AND APPARATUS FOR WINDING A CONTINUOUSLY ADVANCING YARN

(75) Inventors: Michael Schroter, Remscheid; Jorg Spahlinger, Wermelskirchen, both of (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 09/331,724

(22) PCT Filed: Oct. 29, 1998

(86) PCT No.: PCT/EP98/06854

§ 371 Date: Jun. 25, 1999

§ 102(e) Date: Jun. 25, 1999

(87) PCT Pub. No.: WO99/24344

PCT Pub. Date: May 20, 1999

(30) Foreign Application Priority Data

Nov. 7, 1997 (DE) ..... 197 49 196

(51) Int. Cl.[7] ..... B65H 65/00
(52) U.S. Cl. ..... 242/476.2; 242/476.4
(58) Field of Search ..... 242/476.2, 476.4

(56) References Cited

U.S. PATENT DOCUMENTS

| | | | | |
|---|---|---|---|---|
| 4,049,209 | | 9/1977 | Bach et al. . | |
| 4,111,375 | * | 9/1978 | Dolle | 242/476.2 |
| 4,288,267 | * | 9/1981 | McLarty | 242/476.2 X |
| 4,354,642 | * | 10/1982 | Schewe | 242/476.4 |
| 4,474,337 | * | 10/1984 | Schiminski et al. | 242/476.4 |
| 4,969,607 | * | 11/1990 | Busenhart et al. | 242/476.2 X |
| 4,988,048 | | 1/1991 | Lochbronner . | |
| 5,029,762 | | 7/1991 | Behrens et al. . | |
| 5,330,115 | * | 7/1994 | Mayer et al. | 242/476.4 |
| 5,526,995 | | 6/1996 | Westrich et al. . | |
| 5,535,955 | * | 7/1996 | Enger et al. | 242/476.2 |
| 5,681,000 | * | 10/1997 | Gobbels et al. | 242/476.2 X |
| 6,045,081 | * | 4/2000 | Oberstrass et al. | 242/473.8 |

FOREIGN PATENT DOCUMENTS

| | | |
|---|---|---|
| 42 41 290 | 6/1993 | (DE) . |
| 0 329 947 | 8/1989 | (EP) . |
| 0 374 536 | 6/1990 | (EP) . |

* cited by examiner

*Primary Examiner*—Donald P. Walsh
*Assistant Examiner*—Minh-Chau Pham
(74) *Attorney, Agent, or Firm*—Alston & Bird LLP

(57) ABSTRACT

A method and an apparatus for winding a continuously advancing yarn at a constant winding speed to a package on a rotating tube. The tube is mounted on a driven winding spindle. Before the winding cycle, a yarn guide moves the yarn from a threading position to a transfer range for transferring it to the yarn traversing device. In so doing, a transfer tail wind is produced on the tube outside of the traverse range. In accordance with the invention, the speed of the yarn guide is controlled as a function of the winding speed such that a certain number of winds are deposited on the tube for producing the transfer tail wind.

13 Claims, 3 Drawing Sheets

METHOD AND APPARATUS FOR WINDING A CONTINUOUSLY ADVANCING YARN

BACKGROUND OF THE INVENTION

The present invention relates to a method and apparatus for winding a continuously advancing yarn onto a rotating bobbin tube to form a cross wound package, and more particularly to a method and apparatus for initially threading the advancing yarn onto the bobbin tube.

DE 42 41 290 discloses a takeup apparatus, wherein an advancing yarn is wound on a tube.

In this takeup apparatus, a drivable winding spindle mounts the tube. During the winding cycle, i.e., during the winding time of the package, a yarn traversing device reciprocates the yarn on the package surface within a traverse range. Such takeup apparatus are used, for example, in spin lines to wind a plurality of yarns respectively on one package at the same time. In this apparatus, a drivable winding spindle mounts a plurality of tubes one after the other.

To obtain in a subsequent process a continuous operation for further processing such packages, the trailing yarn end of one package is knotted to the leading yarn end of the next package. For this purpose, it is necessary to form during the winding of a package a so-called transfer tail wind outside of the traverse range. To this end, the known takeup apparatus comprises a transfer tail device, wherein a yarn guide guides the yarn outside the traverse range before the actual winding cycle. To wind a transfer tail, the yarn guide is moved from a threading position to a transfer range. In the transfer range, the yarn is transferred to the traversing device. The actual winding cycle can then start.

In the known takeup apparatus, the problem arises that, depending on winding parameters, the unwound yarn length of the transfer tail wind has extremely different lengths. A further problem lies in that the length of the unwound yarn of the transfer tail does not correspond to the length of the yarn required for knotting it, but turns out to be substantially greater. This again leads to an unnecessary waste of yarn.

It is therefore an object of the invention to further develop a method and an apparatus for winding a yarn such that the wound transfer tail wind has substantially exactly the yarn length as is needed for further processing the package.

SUMMARY OF THE INVENTION

The above and other objects and advantages of the present invention are achieved by a method and apparatus where the speed of the movement of the yarn guide from the threading position to the traverse range is controlled as a function of the winding speed. As a result, a predetermined number of winds may be deposited on the bobbin tube within the transfer tail wind. At a winding speed of, for example, 1,000 m/min., the yarn guide is guided at a relatively low speed. To wind the number of winds at a takeup speed of, for example, 6,000 m/min, it is necessary to guide the yarn guide at six times the speed under identical geometric conditions.

As indicated above, the method of the present invention makes it also possible to deposit a predetermined number of winds within the transfer tail wind. The special advantage lies in that it is possible to determine the length of the yarn within the transfer tail wind. This allows to minimize waste of yarn. Furthermore, it is possible to adjust any desired length of the yarn that varies depending on the yarn type or package type.

With the present invention, a constant number of winds may be deposited irrespective of the length of the transfer tail wind, i.e., the distance between the threading position and the traverse range. This provides the advantage that length tolerances of the tube have no influence on forming the transfer tail. In particular in the case of takeup apparatus, wherein a winding spindle mounts a plurality of tubes one after the other, an addition of such length tolerances occurs. This results in that a differently long transfer tail wind forms on each tube being wound. Such tolerances can be compensated by the method of the present invention, so that a substantially identical transfer tail wind is produced on each of the tubes.

A particularly advantageous variant of the method of the invention provides that the speed of the yarn guide is controlled as a function of the position of a traversing yarn guide of the yarn traversing device. Thus, it is possible to adjust the transfer of the yarn from the yarn guide to the traversing yarn guide such that no parallel winds are produced in the transfer range. The transition from the transfer tail wind to the actual package wind is continuous.

A further variant of the method accomplishes that a constant length of the transfer tail wind is produced irrespective of the length of the tube. This method permits producing very uniform transfer tail winds with winds symmetrically deposited on the tube.

The apparatus of the present invention comprises a speed-variable drive of the yarn guide, which can be controlled by a controller. The controller connects to a rotational speed sensor that measures the rotational speed of the winding spindle or directly of the tube. By means of a computing unit, the controller is in a position to generate from rotational speed signals and the number of winds of the transfer tail wind, which are stored in the controller, a control signal that leads to a certain driving speed of the yarn guide.

It is also possible to extend the apparatus of the present invention to a plurality of side-by-side winding positions. In this instance, it is preferred to line up the tubes on a drivable winding spindle one after the other. The yarn guides of each winding position can be operated by means of a drive that is variable in its speed, or each by individual drives.

To transfer the yarn without delay into the yarn traversing device during a yarn transfer, the embodiment of the apparatus which includes a position sensor for detecting the position of the traversing yarn guide of the traversing device, is especially advantageous.

A position sensor can also be used to detect the location of one of the ends of the bobbin tube. This permits the production of transfer tail winds that have always the same distance from the tube end.

An electric stepping motor is especially suited for driving the yarn guide, since the control of the position as well as the speed are simple to realize.

BRIEF DESCRIPTION OF THE DRAWING

In the following, an embodiment is described in more detail with reference to the attached drawings, in which.

DETAILED DESCRIPTION OF THE PREFERRED EMBODIMENTS

Figure 1:
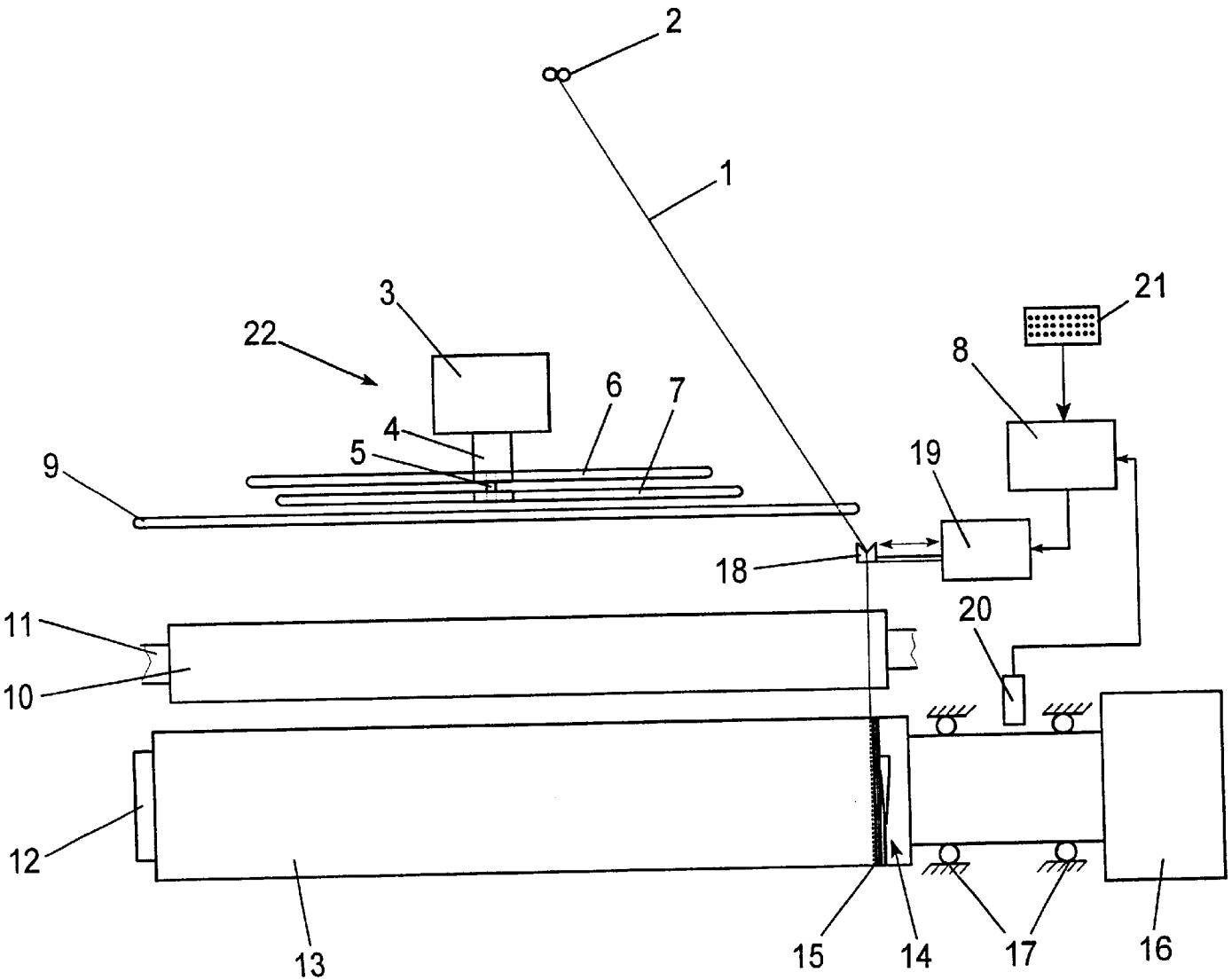
FIG. 1 is a schematic view of a takeup apparatus of the present invention with a yarn guide in the threading position.
Figure 2:
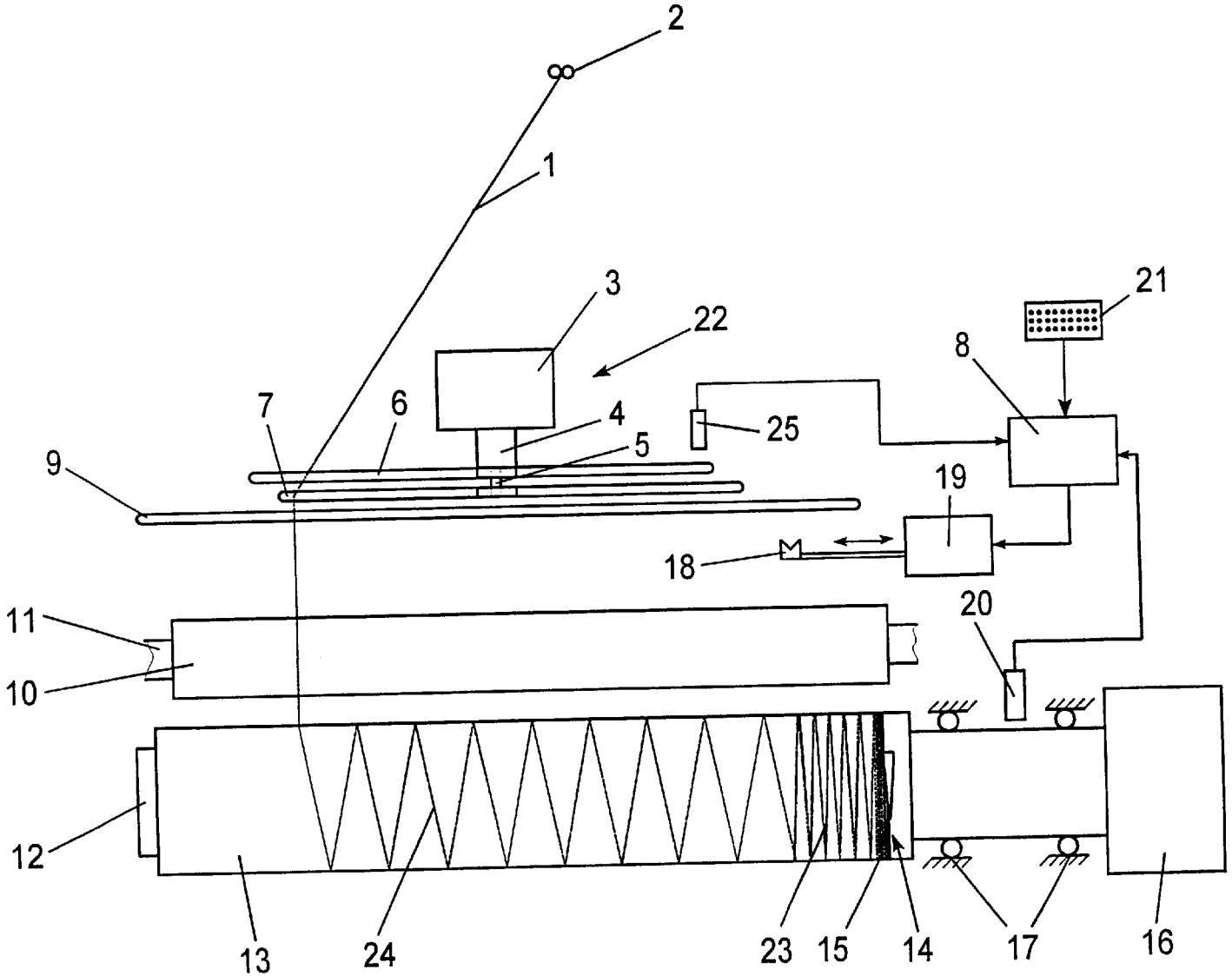
FIG. 2 shows a takeup apparatus of FIG. 1 with the yarn guide in the transfer position.
Figure 3:
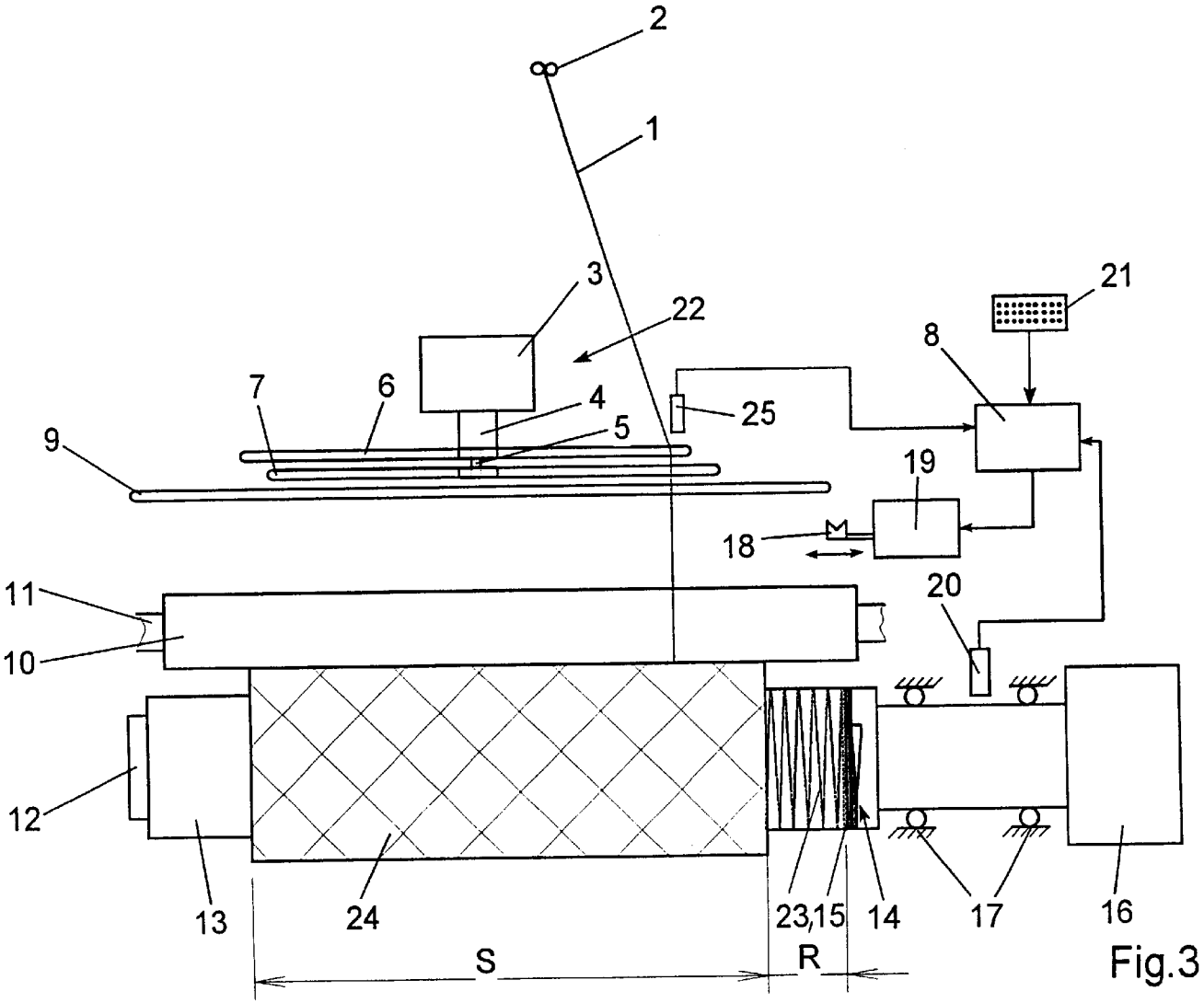
FIG. 3 shows a takeup apparatus of FIG. 1 with the yarn guide in the idle position.

FIGS. 1–3 illustrate a takeup apparatus of the present invention. The apparatus for winding an advancing yarn 1 comprises a winding spindle 12. The winding spindle 12 is supported in cantilever fashion with bearings 17 in a machine frame. At the bearing end, the winding spindle 12 connects to a spindle motor 16. The winding spindle 12 mounts a tube 13. A contact roll 10 extends with its axis parallel to winding spindle 12 in spaced relationship to the tube 13. The contact roll 10 is mounted for rotation with its shaft 11 in the machine frame. A yarn traversing device 22 is arranged in the machine frame upstream of winding spindle 12 and contact roll 10. The traversing device consists of a traverse drive 3. The traverse drive connects to a rotor 4 and a rotor 5. The free end of rotor 5 mounts a traversing yarn guide 7 of the rotary blade type. Likewise, a traversing yarn guide 6 of the rotary blade type is mounted to the free end of rotor 4. Traversing drive 3 drives the rotors 4 and 5 in opposite directions. The operation of the yarn traversing device is described further below.

A guide bar 9 extends between yarn traversing device 22 and contact roll 10.

At its one end the tube 13 mounted on winding spindle 12 possesses a catching slot 14. At the end of tube 13 with catching slot 14, a yarn guide 18 extends above the winding spindle. The yarn guide 18 connects to a drive 19, which moves the yarn guide 18 in a plane parallel to the winding spindle 12 in the axial direction of tube 13 away from the tube end and back to the tube end. The drive 19 connects to a controller 8. The controller 8 comprises an input unit 21. A sensor 20 measuring the rotational speed of winding spindle 12 connects likewise to controller 8.

FIGS. 1–3 illustrate the takeup apparatus in different operating positions. In FIG. 1, the yarn guide 18 is in a threading position. The continuously advancing yarn 1 reaches the takeup apparatus via a yarn guide 2. Before the yarn guide arrives at its threading position, the loose yarn end is threaded for catching the yarn by means of a stringup gun on tube 13 in the region of catching slot 14. In this phase, the yarn guide 18 guides the yarn 1. In so doing, the yarn guide 18 moves from a catching position to the threading position shown in FIG. 1. To this end, the catching position of the yarn guide is located in the normal plane of the catching slot. However, it is also possible to guide the yarn for catching transversely across the catching slot. In this instance, the catching position is located at the tube end or outside the tube. The yarn 1 is thus caught already on tube 13. In the threading position, a so-called waste wind 15 is wound, which consists of several parallel winds to secure the yarn end on the tube.

In a takeup apparatus, wherein the yarn is continuously wound, the yarn is threaded for catching purposes on tube 13 by means of a transfer device. To this end, the takeup apparatus comprises two driven winding spindles. The winding spindle with a fully wound package thereon is rotated out of its operating position. After rotating the winding spindle with an empty tube thereon to the operating position, the transfer device engages in the space between the full package and the empty tube. Such a takeup apparatus is described, for example, in U.S. Pat. No. 5,029,762. To this extent, the takeup machine described therein is herewith incorporated by reference.

Both in the takeup apparatus of FIG. 1 and in a takeup apparatus with two winding spindles, yarn guide 18 guides the yarn 1 for catching on empty tube 13. In this process, the drive 19 moves the yarn guide 18 in direction toward the tube center to its threading position. During this movement, the yarn 1 is caught on the empty tube 13 in catching slot 14. The waste wind 15 is wound in the threading position.

In FIG. 2, drive 19 has moved the yarn guide 18 to a transfer range in direction toward the tube center. During this movement, a transfer tail wind 23 is wound on the rotating tube 13. To be able to deposit on the tube a certain number of winds within the transfer tail wind 23, controller 8 controls the drive 19 such that the yarn guide moves at a previously determined speed. To this end, the controller 8 receives via sensor 20 the rotational speed of winding spindle 12. Likewise, the desired number of winds is input in the controller via input device 21. From the parameters stored in the controller, namely "tube diameter" and "length of the transfer tail wind", as well as the measured rotational speed of the winding spindle and the selected number of winds within the transfer tail wind, a computing unit arranged in controller 8 determines the displacement speed of the yarn guide for forming the transfer tail wind and supplies it as control signals to the drive 19. As soon as the yarn guide reaches the transfer range, traversing yarn guide 7 of yarn traversing device 22 takes over the yarn 1. FIG. 2 illustrates the situation, in which traversing yarn guide 7 has traversed yarn 1 once within the traverse range. The yarn 1 is deposited as a package wind 24 on tube 13 within the traverse range.

The yarn traversing device 22 is constructed as a so-called rotary blade type traversing device. The traversing yarn guide 7 in the form of a rotary blade is rotated by rotor 5 such that the yarn 1 is guided from the right package edge to the left package edge. In so doing, the yarn slides along guide bar 9, so that the position of the yarn on the yarn guide does essentially not change. As shown in FIG. 2, after the yarn 1 has arrived at the left package edge, traversing yarn guide 7 moves below guide bar 9, thereby releasing yarn 1. At the same time, oppositely rotating yarn guide 6 that emerges on guide bar 9, takes over yarn 1 and guides it to the right end of the winding range. To this end, rotor 4 rotates traversing yarn guide 6 in the opposite direction. At the right end of the package, the yarn transfer repeats, in that the traversing yarn guide 6 moves below the guide bar, and traversing yarn guide 7 takes over the yarn.

In FIG. 2, a position sensor 25 extends in the region of the yarn traversing device 22 to detect the position of the traversing yarn guides. The position sensor 25 connects to controller 8. By this arrangement, the controller 8 receives continuously the position of traversing yarn guides 6 and 7. Thus, it is possible to coordinate the starting point for moving the yarn guide 18 from the threading position chronologically with the position of the traversing yarn guide such that traversing yarn guide 7 can take over the yarn 1 without delay in the transfer range directly upon arrival of the yarn guide.

FIG. 3 illustrates yarn guide 18 in its idle position. The package 24 is being wound. After winding the first layers of package 24, contact roll 10 and the package are brought into circumferential contact. Thus, contact roll 10 measures the drive speed of winding spindle 12 during the winding cycle. During the winding cycle, spindle motor 16 is controlled such that the rotational speed of contact roll 10 remains constant. This ensures that the winding speed remains constant during the winding cycle. The package 24 is wound within traverse range S. Between the waste wind 15 and the end of package 24, the transfer tail wind 23 is deposited over a length R.

In the apparatus shown in FIGS. 1–3, the drive 19 of the yarn guide is, for example, an electric drive. In particular, the electric drive may be a stepping motor.

Besides the speed control, it is also possible to input in the drive a distance control by means of controller 8. The distance control permits selecting the threading positions such that a transfer tail wind is always produced of the same length R, irrespective of the length tolerances of the tube, as well as irrespective of the position of the traverse range on the tube.

It possible to extend without difficulties the takeup apparatus and the method of the present invention to a takeup apparatus, wherein a driven winding spindle mounts a plurality of tubes one after the other. Each of the tubes is associated with a yarn guide in the region adjacent the range of movement of the traversing yarn guides. All yarn guides could be driven by means of one drive or even by individual drives. The construction of the drive and the controller correspond to the arrangements shown in FIG. 1.

In the takeup apparatus of FIG. 1, it is possible to use any known yarn traversing device in the place of a rotary blade type traversing device with one set of rotary blades per traverse range. Thus, it is possible to reciprocate the yarn within the traverse range by a traversing yarn guide. The traversing yarn guide can be driven, for example, by a cross-spiraled roll or by a belt drive.

The method of the present invention can likewise be carried out advantageously with devices, wherein the yarn guide is used both for guiding the yarn within the traverse range and for guiding the yarn while winding the transfer tail. In such devices, for example, a belt of a belt drive may mount the yarn guide, with an electric drive, for example, a stepping motor that oscillatingly operates the belt drive.

What is claimed is:

1. A method of threading an advancing yarn onto a rotating bobbin tube at the commencement of a winding operation wherein a traversing mechanism traverse the advancing yarn along the rotating bobbin tube in define a traverse range, and comprising the steps of guiding the advancing yarn by means of a yarn guide located at a threading position which is adjacent one end of the rotating bobbin tube and outside the traverse range, moving the yarn guide and the advancing yarn axially along the bobbin tube from the threading position to the traverse range so as to cause the advancing yarn to be transferred to the traversing mechanism, and so as to form a transfer tail wind on the bobbin tube between the threading position and the traverse range, and controlling the speed of the movement of the yarn guide as it moves along the bobbin tube from the threading position to the traverse range as a function of the winding speed such that a predetermined number of winds are deposited on the bobbin tube within the transfer tail wind.

2. The method as defined in claim 1 wherein the controlling step includes a) determining the diameter of the bobbin tube and the distance between the threading position and the traverse range;

b) sensing the rotational speed of the bobbin tube;

c) selecting a desired number of winds of the transfer tail wind; and d) calculating the speed of the movement of the yarn guide from the parameters identified in steps (a), (b), and (c).

3. The method as defined in claim 2 wherein the calculating step includes maintaining said desired number of winds of the transfer tail wind upon a change in the distance between the threading position and the traverse range.

4. The method as defined in claim 1 wherein the controlling step includes controlling the speed of the movement of the yarn guide as a function of the position of the traversing mechanism so as to control the transfer of the advancing yarn from the yarn guide to the traversing mechanism.

5. The method as defined in claim 1 comprising the further step of changing the threading position so as to maintain a constant length of the transfer tail wind upon a change in the length of the bobbin tube.

6. The method as defined in claim 1 comprising the further step of changing the threading position so as to adapt the length of the transfer tail wind to the position of the traverse range within the length of the bobbin tube.

7. An apparatus for winding an advancing yarn onto a bobbin tube comprising a rotatably driven winding spindle for coaxially mounting the bobbin tube, a yarn traversing mechanism for traversing the advancing yarn along the rotating bobbin tube to define a traverse range upon the rotating bobbin tube, a yarn guide mounted for movement in a direction parallel to the axis of the winding spindle and between a threading position outside of the traversing range and the traverse range, a variable speed drive for moving the yarn guide between the threading position and the traverse range and such that upon movement from the threading position to the traverse range the advancing yarn forms a yarn transfer tail wind on the rotating bobbin tube, a sensor for measuring the rotational speed of the winding spindle, and a controller responsive to the output of the sensor for controlling the speed of said drive as it moves the yarn guide from the threading position to the traverse range.

8. The winding apparatus as defined in claim 7 wherein the controller includes a computing unit which generates from the rotational speed of the winding spindle and from a predetermined number of winds of the transfer tail wind stored in the controller, a control signal which is supplied to said drive.

9. The winding apparatus as defined in claim 8 further comprising a position sensor for determining the position of the yarn traversing mechanism, with said position sensor having an output which is connected to said controller.

10. The winding apparatus as defined in claim 8 further comprising a position sensor for determining the location of one of the ends of the bobbin tube mounted on the winding spindle, with said position sensor having an output which is connected to said controller.

11. The winding apparatus as defined in claim 8 further comprising an input unit operatively connected to said controller for permitting the length of the transfer tail wind and the length of the tube to be input into said controller.

12. The winding apparatus as defined in claim 8 wherein said variable speed drive is an electric stepping motor.

13. The winding apparatus as defined in claim 8 further comprising an input unit operatively connected to said controller for permitting the length of the transfer tail wind or the length of the tube to be input into said controller.

* * * * *